United States Patent [19]

Mima

[11] Patent Number: 4,505,097

[45] Date of Patent: Mar. 19, 1985

[54] METHOD OF SPLICING SPUN YARNS

[75] Inventor: Hiroshi Mima, Joyo, Japan

[73] Assignee: Murata Kikai Kabushiki Kaisha, Kyoto, Japan

[21] Appl. No.: 559,409

[22] Filed: Dec. 9, 1983

[30] Foreign Application Priority Data

Dec. 16, 1982 [JP] Japan ..... 57-221527

[51] Int. Cl.[3] ..... D01H 15/00

[52] U.S. Cl. ..... 57/22

[58] Field of Search ..... 57/22, 261

[56] References Cited

U.S. PATENT DOCUMENTS 4,240,247 12/1980 Matsui et al. ..... 57/22 X
4,344,277 8/1982 Rohner et al. ..... 57/22
4,408,442 10/1983 Rohner ..... 57/22
4,414,798 11/1983 Matsui et al. ..... 57/22
4,416,110 11/1983 Mima ..... 57/22

*Primary Examiner*—Donald Watkins
*Attorney, Agent, or Firm*—Spensley Horn Jubas & Lubitz

[57] ABSTRACT

A spun yarn splicing method wherein ends of both yarns untwisted and positioned in overlapping relationship within a yarn splicing hole are acted upon by a compressed fluid to effect an intended splicing of yarns. Prior to the untwisting operation of the yarn ends, the yarn ends are held and cut, and grasping of the yarn ends are released after the yarns are relaxed and the tension of the yarn is decreased.

6 Claims, 13 Drawing Figures

METHOD OF SPLICING SPUN YARNS

BACKGROUND OF THE INVENTION

This invention rlates to a method of splicing spun yarns, and more particularly to a spun yarn splicing method wherein ends of both yarns positioned in overlapping relationship within a yarn splicing hole are acted upon by a compressed fluid to effect an intended splicing of yarns.

Conventionally, well known as a method of splicing spinning yarns is one wherein either a fisherman's knot or a weaver's knot is formed in order to knot yarns to each other. Such methods are useful for mass production where mechanized, but have a significant defect that a knot formed by knotting of yarns has a thickness of up to three times of that of a single yarn. This results in a disadvantage that yarn breakage is likely to occur to yarns during weaving with such yarns, and a knot will be involved in a woven fabric of a final product, thus necessitating an additional process to remove a portion of the woven fabric around such a knot as a defect of the fabric, to push in such a knot behind the reverse side of the product, or the like.

As a means for removing such defects as described above, there have been proposed another yarn splicing method and device which can provide a completely different joint and structure than a fisherman's knot, a weaver's knot, and so on. In particular, according to this method, portions of ends of yarns which are overlapped one on the other are acted upon by a compressed fluid so that they are intermixed with each other and fibers thereof are interlaced with each other.

So far, there have been proposed various yarn splicing methods which employ such a pneumatic means as described above. Typically, a Japanese Publication Patent No. 56-47108 discloses a method wherein yarn ends are untwisted within nozzle pipes before they are spliced, and then when the yarn ends are to be spliced, in a condition in which an extremity of each of the yarn ends is sucked and held by means of a suction air flow while the other side is held fixed, the yarns put in order in overlapping relationship within a yarn splicing hole are acted upon by a flow of compressed air.

In this method, in case a spinning yarn of low expansibility is used, yarn ends cut off can be sucked into yarn end controlling nozzle pipes disposed adjacent a yarn cutting device without any trouble. However, in case yarns to be spliced are core spun yarns having a core of an elastic polyurethane material and a spun yarn twisted around the core, at the instant when yarns are cut, ends of the yarns thus cut off are released from grasped condition and there appears a sudden contraction of the yarn ends due to the elastic force thereof, which will cause the yarn ends to leap over openings of the yarn end controlling nozzle pipes, preventing the yarn from being sucked into the yarn end controlling nozzle pipes, resulting in error. Consequently, intended splicing of yarns may not be effected in error, and even if yarns are spliced, a joint obtained will be of a low strength and thus become an extremely unsatisfactory one.

SUMMARY OF THE INVENTION

An object of the present invention is to propose an improved pneumatic yarn splicing method by which all kinds of yarns including an elastic spun yarn can be spliced assuredly.

The method of the present invention is particularly suitable for a core spun yarn as described above but is also effective to splicing of conventional spun yarns.

According to the present invention, ends of yarns are held grasped without being released immediately after they are cut off, and in this grasped condition, tension of the yarns are reduced whereafter in a condition in which a restoring tendency of the yarn which has appeared due to elongation of the yarns is substantially removed from the yarns, the yarns are released from their grasped condition to allow the yarn ends to be sucked into control nozzle pipes. Accordingly, yarn ends cut off not only of ordinary yarns but also of special yarns having a particularly high elasticity such as core spun yarn are prevented from jumping over untwisting nozzle pipes due to quick restoration of extension thereof when the yarns are to be spliced to each other. As a result, yarn ends can be assuredly sucked into untwisting nozzle pipes, and thus it is now possible to ensure an action for untwisting a yarn to a degree suitable for splicing thereof.

BRIEF DESCRIPTION OF THE ACCOMPANYING DRAWINGS

DETAILED DESCRIPTION OF THE INVENTION

Now, preferred embodiments of the present invention will be described in detail with reference to the accompanying drawings which show an apparatus to which the present invention is to be applied.

Figure 1:
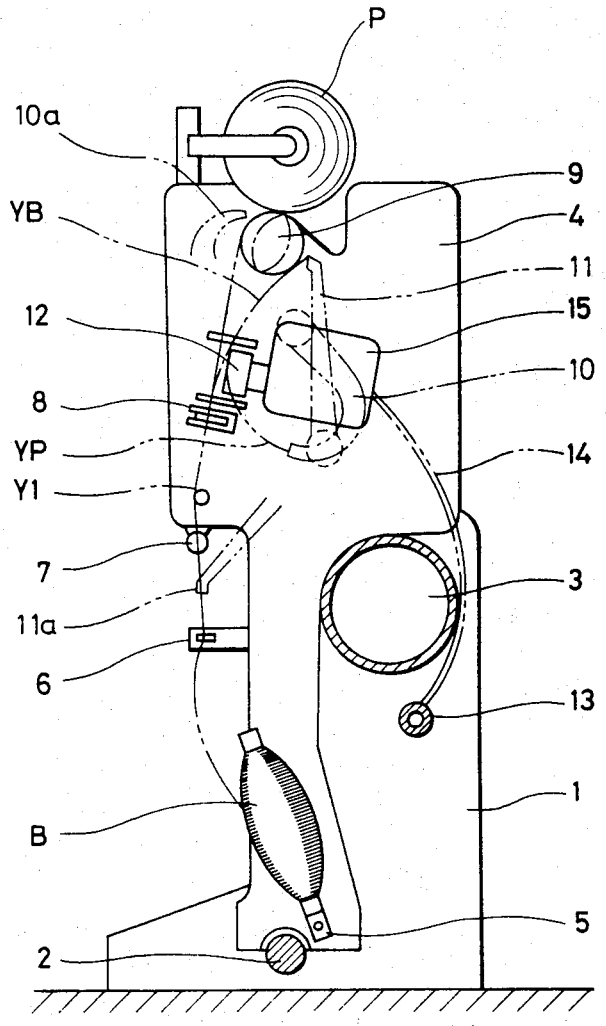
FIG. 1 is a schematic side elevational view of an automatic winder employing a yarn splicing device to which the present invention is applied.

FIG. 1 is a schematic view of an automatic winder to which the present invention is to be applied. The automatic winder includes a pair of side frames 1 between which a rod or pipe 2 and a suction pipe 3 extend. A winding unit 4 is pivotally mounted on the rod 2, and during operation of the winder, it lies on the pipe 3 and is fixed thereto by a suitable means. The pipe 3 is connected to a blower not shown and is always acted upon by a suction air flow.

By the winding unit 4, a yarn is rewound from a bobbin B onto a package P. In particular, a yarn Y1 withdrawn from the bobbin B on a peg 5 passes a guide 6 and suitable tension is provided to the yarn Y1 by means of a tenser 7. Then, the yarn Y1 passes a detecting device 8 which serves both for detection and cutting off of yarn irregularities such as slubs and for detection of yarn passage, and is finally wound on the package P which is rotated by a winding drum 9.

If an irregularity of the yarn is detected by the detecting device 8, a cutter disposed near the detecting device 8 is rendered operative to cut the running yarn and the winding operation is interrupted while a first suction arm 10 and a second suction arm 11 lead a yarn YP on the package P and a yarn YB on the bobbin B, respectively, to a yarn splicing device 12 installed at a position spaced from the normal yarn running path Y1. After completion of splicing of both yarn YP and YB with the yarn splicing device 12, rewinding of the yarn will be resumed. The first and second suction arms 10, 11 are connected to the suction pipe 3 while the yarn splicing device 12 is connected, by means of a thin pipe 14, to a pipe 13 connecting to a pressure air supply source of another circuit so that a fluid such as compressed air may be utilized therefor.

Figure 2:
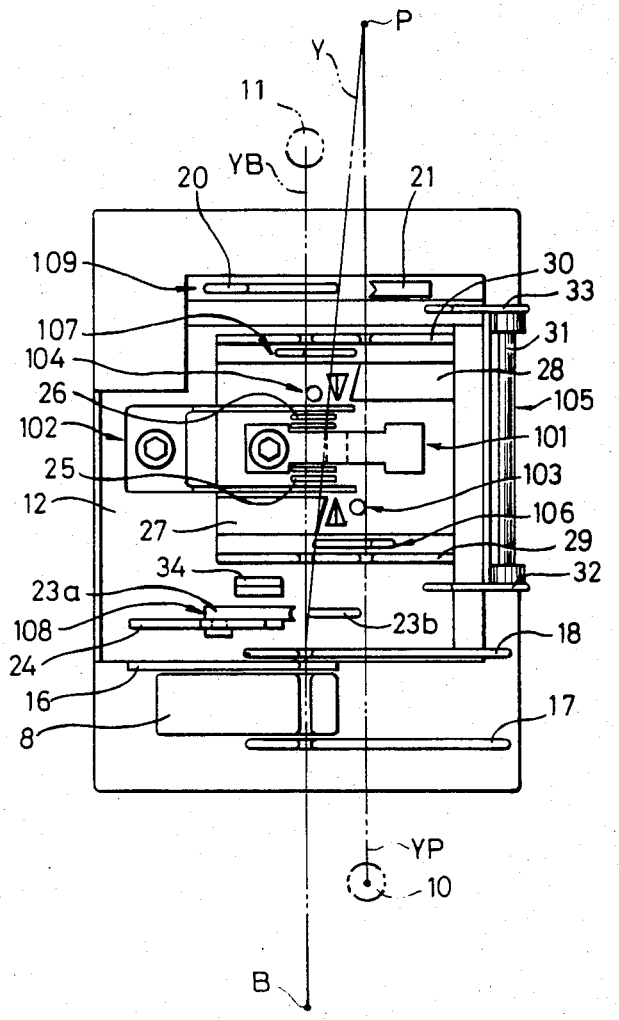
FIG. 2 is a schematic front elevational view showing the entire yarn splicing device of FIG. 1.
Figure 3:
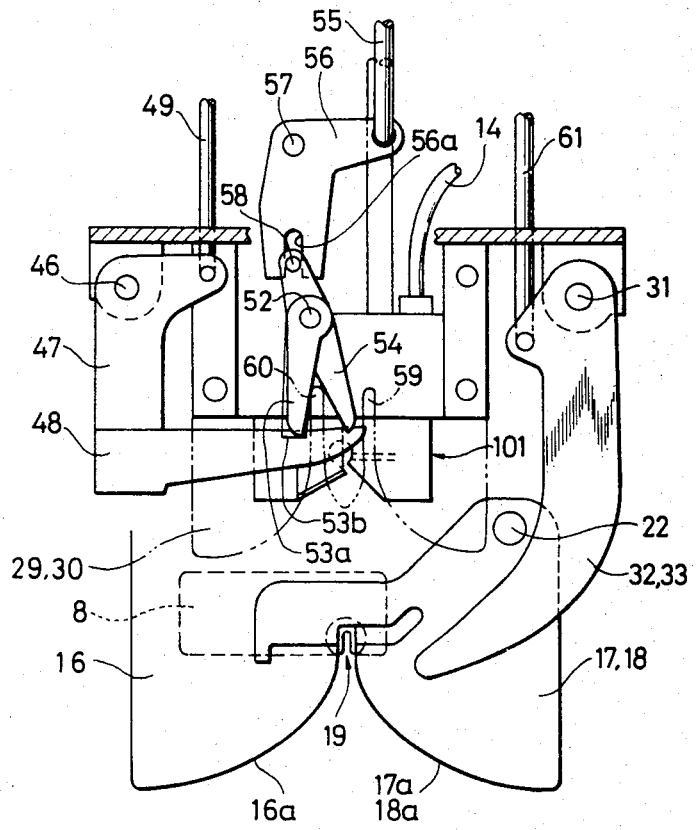
FIG. 3 is a plan view of the yarn splicing device.

The entire construction of the yarn splicing device is illustrated in FIGS. 2 and 3. In particular, the yarn splicing device 12 is basically composed of a yarn splicing member 101, a yarn pressing device 102, yarn end untwisting nozzles 103 and 104, a yarn handling lever 105, yarn cutting and holding devices 106 and 107, and yarn clamp devices 108 and 109.

Figure 4:
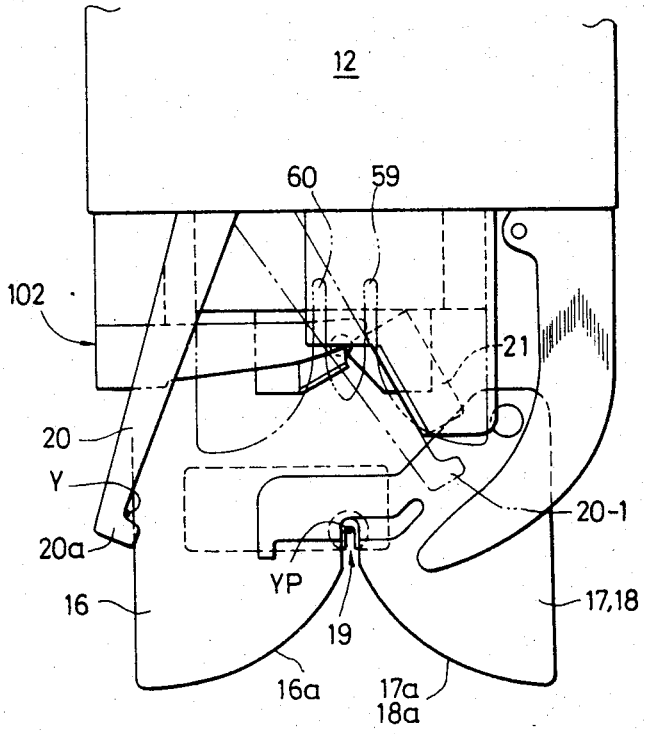
FIG. 4 is a plan view illustrating operation of a clamping pivotal lever.

Sucking openings at ends of the first and second suction arms 10, 11 are whirlingly moved above the yarn splicing device 12 in such a manner as to cross each other until they suck therein yarn ends YP and YB on the package P side and the bobbin B side, respectively, and stop at respective positions outside the yarn splicing device 12. It is to be noted that the suction arms 10 do not operate at the same time and thus operate with some time lag. In particular, at first the yarn end YP on the package P side is moved to a position outside the yarn splicing device 12 by pivotal motion of the suction arm 10, and substantially at the same time with stopping of such motion, a turning lever 20 of the clamp device 109 on the package P side is turned in a counterclockwise direction to the phantom position 20-1 as shown in FIG. 4 by means of a control cam or the like not shown until it is abutted against and stopped by a support block 21 secured in a fixed position. At this instant, the yarn Y is caught and moved by a hookd portion 20s of the turning lever 20 until it is clamped between the support block 21 and the turning lever 20.

In the meantime, while the turning lever 20 is operating, the yarn Y positioned on the fixed guide 16 and the pivotal guides 17, 18 is guided by inclined faces **16*a*, 17*a*, 18*a* of the guides 16, 17, 18, respectively, and is fitted into a guide groove 19 so that the detecting device 8 provided at the same position as the guide groove 19 may effect confirmation whether there is a yarn Y present in the guide groove 19 or not, confirmation whether two or more yarn ends YP are sucked in the suction arm 10 or not, and so on. After confirmation of the yarn Y, the pivotal guides 17, 18 are pivoted in a counterclockwise direction about the pivot 22*b* as shown in FIG. 5 by means of a control cam or the like not shown, and as a result, the yarn end YP is removed from the detecting device 8 and is fitted into relief grooves 17*b*, 18*b* of the pivotal guides 17, 18**.

Further, substantially at the same time with the pivotal motion of the pivotal guides 17, 18, the yarn end YB on the bobbin B side is sucked by the suction arm 11 and is then moved until it is stopped at a position outside the yarn splicing device 12 by pivotal motion of the suction arm 11 in the opposite direction to that of the suction arm 10. Substantially at the same time with the pivotal motion of the suction arm 11, a support plate **23*a* for the yarn clamp device 108 is moved in the same direction with the pivotal lever 20 along a guide plate 24 by means of a control cam or the like not shown, catching the yarn Y thereon, until it is abutted and stopped by a support block 23*b* secured in a fixed position to clamp the yarn Y between the support plate 23*a* and the support block 23*b***.

The yarn splicing member 101 is disposed substantially in the center of the yarn splicing device 12, and on opposite sides of the yarn splicing member 101, there are provided orderly yarn guide pins 25, 26, a yarn regulating device 102, untwisting nozzles 103, 104 and yarn guides 27, 28 yarn cutting and holding devices 106, 107 and fork guides 29, 30. The yarn handling lever 105 is disposed on a side of the yarn splicing device 101 and includes a pivot 31 and levers 32, 33 pivotally mounted on the pivot 31. After the yarn ends YP, YB cut off from the yarn Y by a cutting device not shown due to detection of a slub or the like of the yarn Y by the detecting device 8 have been guided to a position outside the yarn splicing device 12 by operation of the suction arms 10, 11, the yarn handling lever 105 introduces the yarn ends YP, YB toward the yarn splicing device 12. The range of pivotal motion of the yarn handling lever 105 is defined by stops 34 and 70 which are positioned between the fork guide 29 and the clamp member 108 so as to engage with and stop the yarn handling lever 105.

Figure 5:
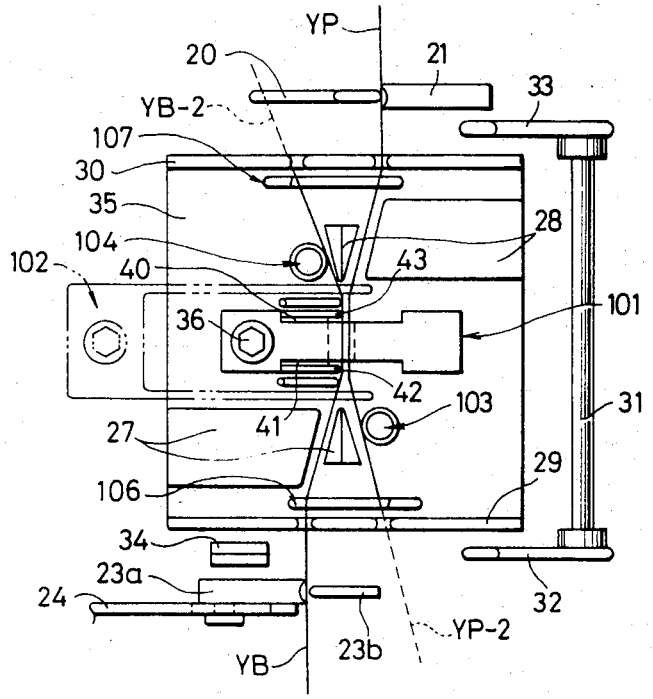
FIG. 5 is a front elevational view illustrating a yarn passage when yarn ends are inserted into a yarn splicing hole.
Figure 6:
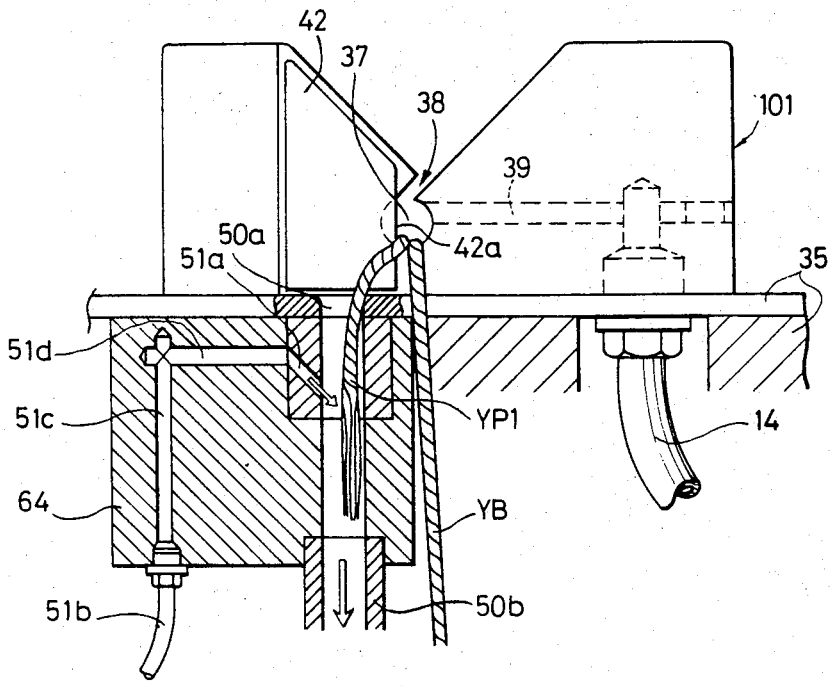
FIG. 6 is a sectional plan view showing the yarn splicing hole and an untwisting nozzle.

Referring now to FIGS. 5 and 6, the yarn splicing member 101 located substantially in the center of the yarn splicing device 12 is screwed 36 onto a bracket 35 and has a cylindrical yarn splicing hole 37 perforated substantially in the center thereof while it has a slit 38 formed therein which extends in a tangential direction of the yarn splicing hole 37 thereof in such a manner as to facilitate insertion of a yarn Y into the yarn splicing hole 37 from outside. The yarn splicing member 101 further has a cylindrical injection nozzle hole 39 perforated therein which opens tangentially to the yarn splicing hole 37. It is to be noted that, while in the embodiment the cylindrical nozzle hole 39 is perforated longitudinally of and substantially in the center of the yarn splicing hole 37, the nozzle hole 39 may otherwise be modified to have a laterally elongated cross section such as an elliptic, rectangular, or channel-like cross section, or else a plurality of such nozzle holes 39 may be provided for the yarn splicing member 101. Particularly in case a yarn to be spliced is thick, such as, for example, a yarn of the yarn count Nm 10 or so or even greater, a nozzle hole 39 would be more effective if it has a laterally elongated cross section.

The yarn splicing member 101 has control plates 42, 43 screwed onto opposite sides thereof with spacers 40, 41 interposed therebetween. A particular side edge **42*a*, 43*a* of each of the control plates 42, 43 is positioned to intercept part of an opening of the yarn splicing hole so that it may serve to positioning of a yarn end in cooperation with a yarn regulating plate 48 as described later to prevent the yarn end from being escaped from the yarn splicing hole 37 due to a flow going out of the yarn splicing hole 37**.

Further, referring again to FIGS. 2 and 3, the yarn regulating device 102 which extends on opposite sides of the yarn splicing member 101 is moved in synchronism with pivotal motion of the yarn handling lever 105 as described later to pull out the yarn ends YP1, YB1 which have been untwisted by the untwisting nozzles 103, 104 and then to set the yarn ends YP1, YB1 into the yarn splicing hole 37 of the yarn splicing member 101 while it controls the position of the yarns YP, YB. In particular, the yarn regulating plate 48 is screwed onto a pivotal lever 47 which is mounted for pivotal motion around a pivot 46 secured in a fixed position and a rod 49 is connected to the pivotal lever 47 so that the yarn regulating plate 48 may be pivoted by the rod 49 when the rod 49 is operated by a control cam not shown.

Figure 7:
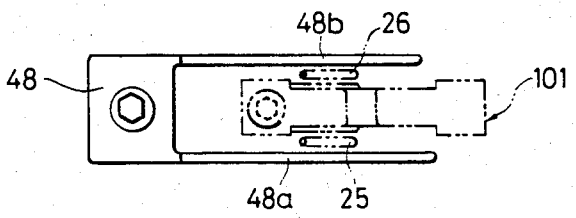
FIG. 7 is a front elevational view showing a yarn regulating lever.
Figure 8:
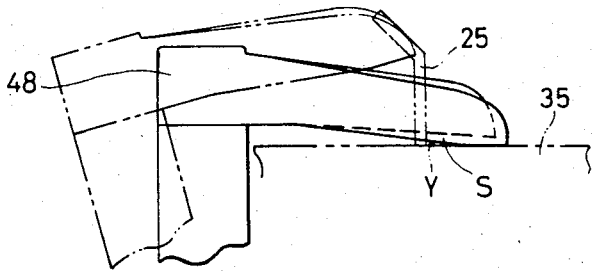
FIG. 8 is a plan view of the yarn regulating lever.

Details of the yarn regulating plate 48 are seen from FIGS. 7 and 8. The yarn regulating plate 48 is forks 48*a*, 49*b* towards an end thereof. The forks 48*a*, 48*b* have rather different configurations from each other. In particular, when the yarn regulating plate 48 is pivoted to a position in which one fork 48*a* is abutted against a face of the bracket 35 with a yarn Y clamped between an upper face of the bracket 35 and the yarn guide pin 25 and the fork 48*a*, a small gap S is formed between the other fork 48*b* and the upper face of the bracket 35 and the yarn guide pin 26 which is sufficient to allow the yarn Y to pass therethrough, and as a result, only control of the position of the yarn Y in a transverse direction to the yarn Y is effected.

It is to be noted that regulation of a yarn with the fork 48*a* of the yarn holding down plate 48 is necessary to prevent possible untwisting of one of yarns due to an action of a balloon which may be caused to appear at yarn ends YB1, YP1 by an action of a compressed fluid as described hereinabove.

Accordingly, such regulation with the fork 48*a* is sufficient if it only prevents the yarn Y from being untwisted even by a ballooning action. If the regulating force is excessively strong, then fluffs will be undesirably raised on the yarn. Further, since the other yarn Y is rotated in a direction in which it is progressively twisted by a ballooning action, it need not particularly held and only a regulating force to control the position of the yarn Y will be sufficient.

Each of the untwisting nozzles 103, 104 disposed on opposite sides of the yarn regulating device 102 has a nozzle hole 50*a* formed therein for untwisting the yarn end YB1 or YP1 as seen in FIG. 6. Thus, the yarn end YB1 on the bobbin side B and the yarn end YP1 on the package side P to be spliced to each other are introduced into the nozzle holes 50*a* of the untwisting nozzles 103, 104 by way of the yarn splicing hole 37. Such introduction of the yarn ends YB1, YP1 into the nozzle holes 50*a* is effected by a sucking action of the aforementioned suction pipe 3 connected to a flexible pipe 50*b*. After the yarn end YP1 has been introduced into the nozzle hole 50*a*, fluid is injected from an injection nozzle 51*a* opened to the nozzle hole 50*a* in an inclined relationship thereby to act to untwist the yarn end YP1 and to bring individual fibers of the yarn end YP1 substantially into parallel conditions relative to each other.

In particular, the yarn Y having a free end thereof inserted into the sucking hole 50*a* is untwisted at the end thereof by compressed fluid injected from the injection nozzle 51*a*. Since the yarn Y may have either two kinds of twisting including "Z-twists" and "S-twists" and the yarns Y are twisted in opposite directions to each other, it is necessary that the injecting direction of the injection nozzle 51*a* be taken into consideration in accordance with the twisting direction of the yarn Y.

Referring again to FIGS. 2 and 3, since the yarn cutting and holding device 106, 107 have a similar constuction, only the one device 107 will be now described. In particular, the yarn cutting and holding device 107 is composed of two upper and lower fixed plates 53*a*, 53*b* and a movable plate 54 disposed to move into a gap between the fixed plates 53*a*, 53*b*, and it grasps a yarn between the one fixed plate 53*b* on the side of the yarn splicing member and one side of the movable plate 54 while it cuts the yarn by means of the other fixed plate 53*a* and an edge portion on the other side of the movable plate 54. Accordingly, when the movable plate 54 is moved into the gap between the fixed plates 53*a*, 53*b*, only after the movable plate 54 grasped on the side of the yarn splicing member simultaneously with cutting of the yarn is returned to a full line position of FIG. 3, the yarn ends thus cut off are rendered free.

When a rod 55 is operated by means of a control cam not shown, a bifurcated lever 56 is pivoted around a pivot 57 whereupon a forked position 56*a* of the lever 56 moves a support pin 58 on the side of the movable plate 54 thereby to move the movable plate 54. The timing of such operation of the movable plate 54 is associated with operation of the yarn handling lever 105 as described hereinafter an and is thus cam controlled such that the holding of the movable plate 54 is released at a point of time when tension of the yarn after cutting and holding of the yarn is decreased as the yarn handling lever 105 is retreating to its initial position. Further, fork guides 29, 30 are disposed outside the yarn cutting and holding devices 106, 107, respectively. Each of the fork guides 29, 30 has a guide groove 59, 60 formed therein.

The yarn handling lever 105 disposed on one side of the yarn splicing device 12 is pivoted, when a rod 61 is operated by means of a control cam or the like, in a clockwise direction about an axis of and together with a shaft 31 to introduce the yarns YP, YB into the guide grooves 59, 60, respectively.

Figure 9:
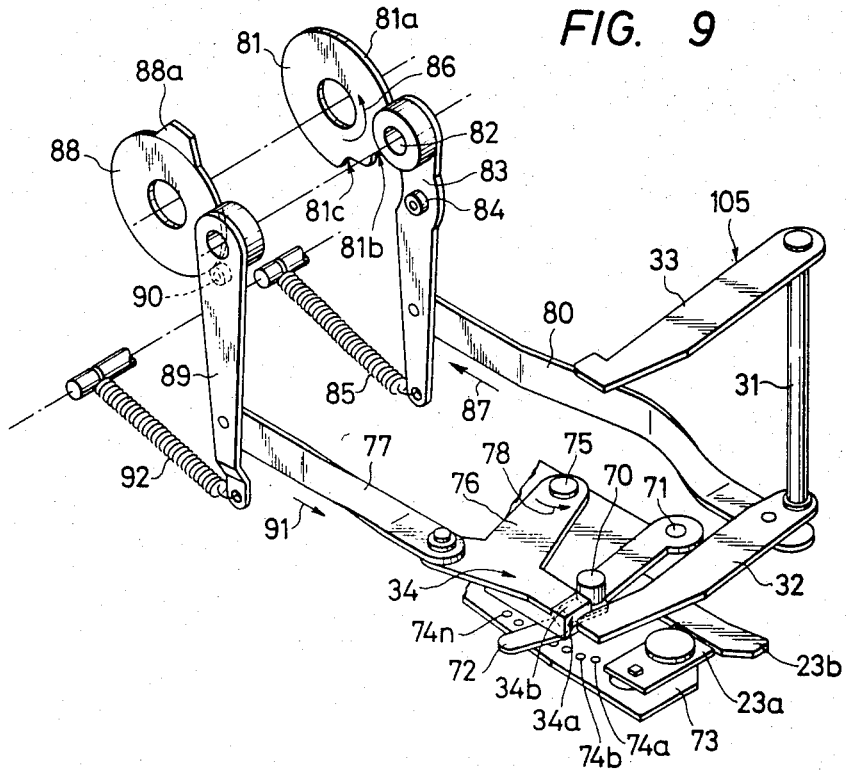
FIG. 9 is a perspective view showing first and second stops for a yarn handling lever.

The yarn handling lever 105 is mounted for pivotal motion between a first limit position in which it is abutted against a first stop 70 to determine the length of a yarn end to be cut off and a second position in which it is abutted against a second stop 34 for adjustment of the length of yarn ends to be overlapped to each other as shown in FIG. 9.

Figure 13:
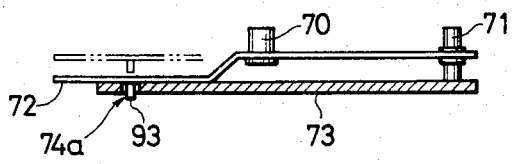
FIG. 13 is a side elevational sectional view showing an adjusting lever.

In particular, the first stop 70 is secured to an adjusting lever 72 mounted for pivotal motion on a fixed pivot 71. A pin 93 is fixedly mounted on a bottom face of the adjusting lever 72 as shown in FIG. 13. The pin 93 is positioned for selective engagement with positioning holes 74*a* to 74*n* pefforated in a plurality of positions in an arcuate row around the pivot 71 on the fixed plate 73 to selectively determine the position of the adjusting lever 72, that is, the position of the stop 70. Movement of the lever 70 is allowed only while it is held lifted in a two dots and dash lines of FIG. 13. In particular, when yarns are cut by the yarn cutting and holding devices 106, 107 after the yarn end YP on the package side and the yarn end YB on the bobbin side have been clamped by the clamp devices 108, 109, respectively, as shown in FIGS. 2 and 3, a lever 32 of the yarn handling lever 105 is in the position in which it is abutted against the first stop 70 to keep constant the length from the clamped points to the extremities of the yarn ends.

It is to be noted that means for positioning the adjusting lever 72 is not limited to the holes 74*a* to 74*n* and it may alternatively be possible that serrations be formed in an arcuate row around the pivot 71 and the pin secured to the adjusting lever be engaged with the serrations. It is also possible that an arcuately extending elongated slot be perforated in the fixed plate and a threaded rod which is secured to the adjusting lever be extended through and moved along the elongated slot and secured in position by means of a bolt, thus allowing infinite adjustment of the position of the adjusting lever 72.

On the other hand, the second stop 34 includes a block **34*b* secured to an end of a lever 76 which is mounted for pivotal motion between two limit positions around a fixed pivot 75. The lever 76 can be pivoted by a rod 77 connected to a control cam 88 so that the second stop 34 can be moved between and fixed to an operative position as shown by a full line in FIG. 9 and an inoperative position pivoted in a direction of an arrow mark 78 around the pivot 75**.

The lever 32 of the yarn handling lever 105 is mounted for pivotal motion around the axis of the shaft 31 and is connected by way of a rod 80 to a lever 83 which is rocked around a shaft 82 by a control cam 81. A spring 85 is connected to the lever 83 to urge a cam follower 84 on the lever 83 toward a cam face **81*a* of the control cam 81. The spring 85 also urges, by way of the rod 80, the yarn handling lever 32 toward the stops 34, 70. Accordingly, the lever 83 is rocked following the configuration of the cam face 81*a* of the control cam 81, and in order to allow the yarn handling lever 32 to be pivoted to a selected position provided by the first stop, one of recesses 81*b* and 81*c* of the cam face 81*a*, that is, the recess 81*b*, has a depth sufficient to allow pivotal motion of the yarn handling lever 32 to the top 70 which is positioned at the specific hole 74*b* of the fixed plate 83. The other recess 81*c* may only be of a depth to allow pivotal motion of the lever 32 to the stop 34** in the fixed position.

Accordingly, if the cam 81 is rotated in a direction of an arrow mark 86, the recess **81*b* of the control cam 81 allows the rod 80 to be pulled in a direction of another arrow mark 87 so that the lever 32 is pivoted to a position of the first stop 70. Then, after the lever 32 is once pivoted back in the opposite direction, the cam follower 84 is now engaged with the other recess 81 of the control cam 81 and as a result, the yarn handling lever 32 is pivoted to a position defined by the second stop 34**.

At this instant, the lever 32 is once pivoted back in a direction away from the stop 70, and at the same time, a cam follower 90 on the lever 89 is engaged with a lobe **88*a* of the cam 88 so that the rod 77 is pushed in a direction of an arrow mark 91. As a result, the lever 76 is pivoted in the direction of the arrow mark 78 around the pivot 75** to move the second stop to its operative position.

Accordingly, when the yarn handling lever 105 is once pivoted in the direction away from the first stop 70 from the position abutted against the first stop 70 and both yarn ends cut off are sucked into the untwisting nozzles 103, 104 so as to be untwisted whereafter the yarn handling lever 105 is pivoted again toward the first stop to draw out the yarn ends in the untwisting nozzles, the second stop 34 has been pivoted from its inoperative position not shown to and is now in the operative position shown, that is, the position in which it extends beyond the stop 70. As a result, the lever 32 is stopped at a position in which it is abutted by the second stop 34, thus determing the amount of the yarn ends to be drawn out from the untwisting nozzles 103, 104, that is, the length of portions of the yarn ends YB, YP which are to overlap one on the other. Accordingly, as the height of the lobe **88*a* of the cam face of the cam 88 decreases, the amount of pivotal motion of the yarn handling lever 105 increases, thereby increasing the amount of the yarn ends drawn out from the nozzles 103, 104. On the contrary, as the lobe 88*a* of the cam 88 becomes higher, the amount of pivotal motion of the yarn handling lever 105** becomes smaller, thereby reducing the amount of the yarn ends drawn out from the untwisting nozzles.

Now, operations of the yarn splicing device will be described in detail.

Figure 10:
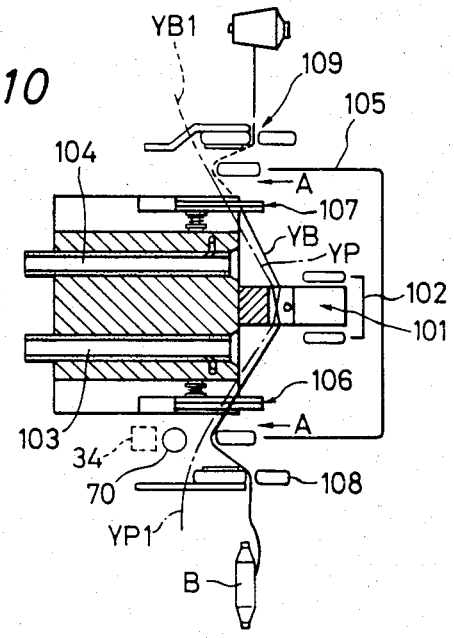
FIGS. 10 through 12 are diagrammatic representations illustrating different phases of a yarn splicing operation.

Referring to FIG. 10, a yarn YB on the bobbin B side is clamped on the clamp device 108 while another yarn YP on the package side P is clamped on the clamp device 109, and the yarn handling lever 105 has been moved in a direction of an arrow mark A and is now abutted against the first stop 70. In this condition, the yarn cutting and holding device 106 is put into operation so that both yarn ends YB, YP are cut off in a fixed length and are grasped simultaneously thereby. Accordingly, if the position of the first stop 70 is varied, the length of yarn ends from the clamped points to the yarn cutting and holding device can be varied thereby depending upon the kind of yarns.

Figure 11:
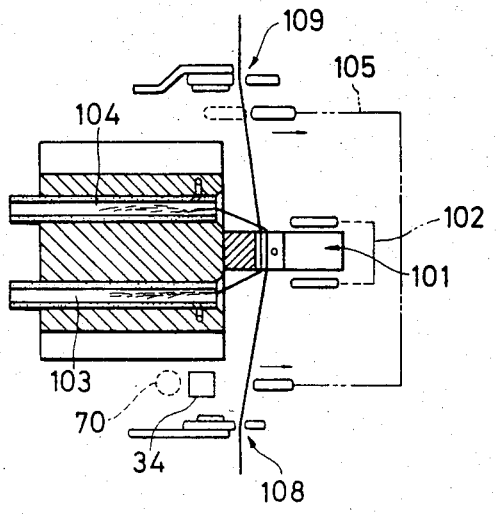

Subsequently, with extremities of both yarn ends YP, YB held grasped by the yarn cutting and holding devices 106, 107, the yarn handling lever 105 is moved away from the yarns while the yarn YP between the clamp device 109 and the yarn cutting and holding device 106 and the yarn YB between the clamp device 108 and the yarn cutting and holding device 107 are released from their strained conditions thereby to relax the strained yarns with the yarn handling lever 105. In this condition, the yarns are released from grasping by the yarn cutting and holding devices to allow the yarn ends YP, YB to be sucked into the untwisting nozzles 103, 104 due to sucking actions of the nozzles 103, 104. At this instant, the yarns are in their relaxed conditions so that they are assuredly sucked into the nozzles due to sucking actions of the latter thus without leaping over the openings of the untwisting nozzles due to an instantaneous contracting force upon release of the grasped yarns (FIG. 11).

Figure 12:
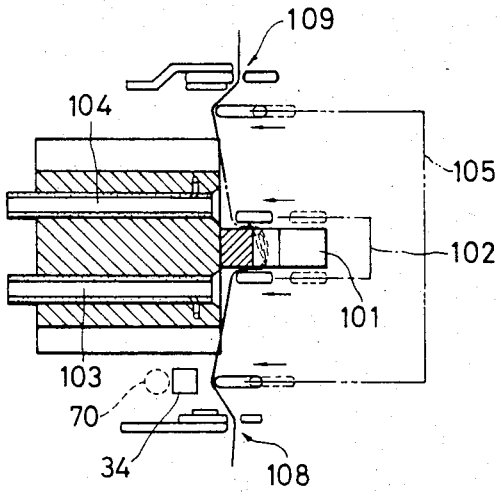

Substantially at the same time as or just before or after the yarn end YB1, YP1 are untwisted into a condition suitable for splicing thereof by means of the untwisting nozzles 103, 104 and then sucking actions of the untwisting nozzles 103, 104 are stopped, the yarn putting aside lever 105 is rendered operative again as shown in FIG. 12 and is pivoted until the lever 32 thereof as shown in FIG. 9 is abutted against the second stop 34 while guiding the respective yarn ends YB1, YP1. In the meantime, the yarn holding down lever 102 is rendered operative and is pivoted until it is abutted against a face of the bracket 35 shown in FIG. 8 thereby to hold down the yarns and to cooperate with the control plate 42 shown in FIG. 6 to position both yarn ends so as to contact with each other within the yarn splicing hole.

By operation of the yarn handling lever 105 and the yarn regulating device 102, the yarn ends YB1, YP1 remaining within the untwisting nozzles 103, 104 are drawn into the yarn splicing hole 37, and extremity portions of the yarn ends to be spliced to each other are set in a mutually overlapping condition. In this case, the amount of pivotal motion of the yarn putting aside lever 105 is varied depending upon the position of the second stop 34 shown in FIGS. 9 and 12 and is thus adjusted by replacement of the cam 88 so that the length of the extremity portions of the yarn ends to be overlapped to each other may be held substantially constant regardless of the kind of the yarn used.

It is to be noted here that, if the arrangement is such that, when both yarn ends are drawn into the yarn splicing hole 37 by the yarn handling lever 105 and the yarn regulating lever 102, either they have their extremities partially slightly left in the untwisting nozzle pipes or they are acted upon by a sucking holding down force of a sucking air flow around the openings of the nozzle pipes in order to provide tension to the yarn ends, then the yarns YP, YB will be put in order to the yarn splicing position in the interior of the yarn splicing hole 37. Thus, if compressed air is injected into the yarn splicing hole, the yarn ends thus put in order are intertwined with each other while the extremities of the yarn ends subjected to the sucking air flow are acted upon by air flows and also by rotation of the yarns themselves so that they are enveloped to the join therebetween, thereby forming a beautiful join of yarns.

Further, the second stop 34 is located nearer to the yarn splicing hole 37 than the second stop 70, and particularly in case of yarns having high elasticity such as a core spun yarn, the amount of pivotal motion of the yarn handling lever 105 is preferably made smaller than the amount provided at least by the first stop 70. An excessively large amount of pivotal motion of the yarn handling lever 105 might possibly cause an absence of overlapping portions of both yarn ends within the yarn splicing hole 37.

After completion of splicing of yarns, the clamp devices 108, 109 release the yarns clamped thereon, the yarn handling lever 105 and the yarn regulating lever 102 are retracted, and the yarns are removed from the yarn splicing hole 37 to begin their travel.

As apparent from the foregoing description, according to the present invention, when yarns are to be cut while a yarn end at a package side and another yarn end at a bobbin side are held pushed in a yarn cutting position, extremities of the yarn ends are grasped at the same time with cutting of the yarns, and then after both yarns are relaxed, the extremities of the yarn ends are released from the grasped condition to allow the yarn ends to be sucked into yarn untwisting nozzle pipes.

What is claimed is:

1. A method of splicing spun yarns, wherein the method comprises steps of; introducing a yarn on a package side and a yarn on a bobbin side into a pair of yarn cutting and holding devices and a yarn splicing member disposed between the yarn cutting and holding devices; cutting the ends of each yarns; sucking each end of the yarns into yarn untwisting nozzle pipes, respectively; positioning the untwisted ends of yarns in overlapping relationship within the yarn splicing hole; and acting upon them a compressed fluid to effect an intended splicing of yarns, characterized in that at the same time or just before the end of the yarn on the package side and the end of another yarn on the bobbin side in yarn cutting positions, the yarn ends are grasped, and after cutting of the yarns, both yarns are relaxed whereafter the yarn ends thus cut off are released from the grasped condition to allow the yarn ends to be sucked into the yarn untwisting nozzle pipes.

2. A method according to claim 1, wherein said steps of pushing yarns into the yarn cutting and holding devices and the splicing member and of relaxing both yarns after cutting of the yarns are performed by means of a yarn handling lever, which is disposed on a side of the splicing member and includes a pivot and levers pivotally mounted on the pivot, and said grasped condition of the yarn ends is released at a point of time when tension of the yarn after cutting of the yarn is decreased by the retreating movement of the yarn handling lever to its initial position.

3. A yarn splicing apparatus for practising the method according to claim 1 or 2, wherein it includes:

a yarn splicing member having a yarn splicing hole to which a compressed fluid injection nozzle is opened;

yarn cutting and holding devices which are disposed at a bobbin side and a package side of the splicing member, respectively and comprises two upper and lower fixed plates and a movable plate disposed to move into a gap between the fixed plates; and a yarn handling lever which is disposed on one side of the yarn splicing member and the cutting and holding devices and includes a pivot and levers pivotally mounted on the pivot and extending in parallel relation above and below the splicing member and the cutting and holding devices, the timing of such operation of said movable plate being associated with operation of said yarn handling lever by means of cams so that the holding of the movable plate is released at a point of time when tension of the yarn after cutting and holding of the yarn is decreased as the yarn handling lever is retreated to its initial position.

4. A yarn splicing apparatus according to claim 3, wherein said yarn handling lever is mounted for pivotal motion between a first limit position in which it is abutted against a first stop to determine the length of a yarn end to be cut off and a second position in which it is abutted against a second stop for adjustment of the length of yarn ends to be overlapped to each other in the splicing hole.

5. A yarn splicing apparatus according to claim 4, wherein said first stop is secured to an adjusting lever mounted for pivotal motion on a fixed pivot and having a engagement means at a plurality of positions with a fixed plate to selectively determine the position of the stop, and said secnd stop is a lever which is mounted for pivotal motion between two limit positions around a fixed pivot, includes a block secured to an end of the lever, said block being abutted to one of the lever of the yarn handling lever, and is pivoted by a rod secured at the another end of the lever and is operated by a control cam through a rod.

6. A yarn splicing apparatus according to claim 5, wherein one of the levers of the yarn handling lever is connected by way of a rod to a lever which is rocked around a shaft by a control cam, a spring is connected to the lever to urge a cam follower mounted on the lever toward a cam face of the control cam and the spring also urges, by way of the rod, the yarn handling lever toward the first and second stops.

* * * * *